US007614100B1

(12) United States Patent
Barrington et al.

(10) Patent No.: US 7,614,100 B1
(45) Date of Patent: Nov. 10, 2009

(54) UTILITY ROLLED BLANKET WITH INTEGRAL STRAP SECURING ASSEMBLY

(76) Inventors: Wendy Barrington, 22207 52nd Ave. W., Mountlake Terrace, WA (US) 98043; Tom Barrington, 22207 52nd Ave. W., Mountlake Terrace, WA (US) 98034

( * ) Notice: Subject to any disclaimer, the term of this patent is extended or adjusted under 35 U.S.C. 154(b) by 6 days.

(21) Appl. No.: 12/204,120

(22) Filed: Sep. 4, 2008

(51) Int. Cl.
*A47G 9/04* (2006.01)
*A47G 9/081* (2006.01)

(52) U.S. Cl. ..... 5/420; 5/421; 5/413 R; 5/502; 5/922; 383/4

(58) Field of Classification Search ..... 5/417–420, 5/413 R, 413 AM, 421, 482, 502, 922; 383/4; 224/576, 577; 482/23, 142; 190/2
See application file for complete search history.

(56) References Cited

U.S. PATENT DOCUMENTS

| | | | | | |
|---|---|---|---|---|---|
| 124,007 | A * | 2/1872 | Nobles | 5/419 |
| 1,237,243 | A * | 8/1917 | Conner | 5/420 |
| 1,930,942 | A * | 10/1933 | Pringle | 5/419 |
| 3,268,922 | A * | 8/1966 | Moxley | 5/420 |
| 3,477,552 | A * | 11/1969 | Goldman | 190/2 |
| 4,097,944 | A | 7/1978 | Yulish | |
| 4,195,378 | A | 4/1980 | Parker | |
| 4,329,747 | A * | 5/1982 | Russell | 5/420 |
| 4,587,682 | A * | 5/1986 | Schultz | 5/413 R |
| 5,210,891 | A * | 5/1993 | Avital et al. | 5/420 |
| 5,404,600 | A * | 4/1995 | DeMars | 5/413 R |
| 5,533,653 | A * | 7/1996 | Kaufman | 224/577 |
| 5,622,300 | A | 4/1997 | Robinson | |
| 5,730,529 | A | 3/1998 | Fritz | |
| 5,740,566 | A | 4/1998 | Stacy | |
| 6,061,849 | A | 5/2000 | Seals | |
| 6,223,367 | B1 | 5/2001 | French et al. | |
| 6,463,604 | B1 * | 10/2002 | Reveron et al. | 5/413 R |
| 6,742,635 | B2 * | 6/2004 | Hirshberg | 190/2 |
| 6,839,921 | B2 | 1/2005 | Cloutier et al. | |
| 6,951,039 | B2 * | 10/2005 | Roseff | 5/706 |
| 7,007,322 | B2 | 3/2006 | Alane | |
| 7,171,707 | B2 * | 2/2007 | Landay | 5/413 R |
| 7,401,370 | B2 * | 7/2008 | McClintock | 5/706 |
| 2004/0154105 | A1 * | 8/2004 | Roseff | 5/690 |
| 2004/0155077 | A1 * | 8/2004 | Cullen et al. | 224/153 |
| 2005/0236450 | A1 * | 10/2005 | Iannini | 224/577 |
| 2006/0053552 | A1 * | 3/2006 | Peterson et al. | 5/413 R |
| 2007/0295773 | A1 * | 12/2007 | Wegenhoft | 224/576 |

FOREIGN PATENT DOCUMENTS

| | | |
|---|---|---|
| JP | 7213337 | 8/1995 |
| JP | 9140536 | 6/1997 |
| JP | 2003034171 | 2/2003 |

* cited by examiner

*Primary Examiner*—Alexander Grosz
(74) *Attorney, Agent, or Firm*—Michael I Kroll

(57) ABSTRACT

A two ply ground cover comprising a top acrylic rug layer and a bottom canvas layer having a strap retainer fastened to the bottom side with straps extending therefrom and a handle fixed therebetween.

14 Claims, 11 Drawing Sheets

UTILITY ROLLED BLANKET WITH INTEGRAL STRAP SECURING ASSEMBLY

BACKGROUND OF THE INVENTION

1. Field of the Invention

The present invention relates generally to ground covers and, more specifically, to a two ply ground cover comprising a bottom canvas layer and a top acrylic rug layer.

The ground cover of the present invention is easily stored and or transported. The ground cover is a foldable/rollable blanket having a plurality of straps built in straps with cooperating rings whereby said blanket can be folded and rolled into a compact configuration and held by said straps.

To secure the ground cover, the straps may be outfitted with hook and loop fasteners, wherein said straps are placed through the rings where said straps may attach to themselves using the provided hook and loop material securing the blanket into a compact and easily transportable package.

A rigid clip is fixedly attached to the distal end of each strap to provide support and prevent tearing of the seams. The fastening and lifting systems are further reinforced by an additional patch of canvas that is double stitched along the outside border to the canvas cover and interiorly stitched to both the securing straps and lifting handle.

In one embodiment, the top and bottom are fixedly attached by means of a zipper. In turn, additional padding such as an air, foam, or composite mattress can be contained within. Additionally a battery pack with heating elements may be incorporated into the device for heating.

2. Description of the Prior Art

There are other bed rolls designed for outdoor use. Typical of these is U.S. Pat. No. 4,097,944 issued to Yulish on Jul. 4, 1978

Another patent was issued to Parker on Apr. 1, 1980 as U.S. Pat. No. 4,195,378. Yet another U.S. Pat. No. 5,622,300 was issued to Robinson on Apr. 22, 1997 and still yet another was issued on Mar. 24, 1998 to Fritz as U.S. Pat. No. 5,730,529.

Another patent was issued to Stacy on Apr. 21, 1998 as U.S. Pat. No. 5,740,566. Yet another U.S. Pat. No. 6,061,849 was issued to Seals on May 16, 2000. Another was issued to French et al. on May 1, 2001 as U.S. Pat. No. 6,223,367 and still yet another was issued on Jan. 11, 2005 to Cloutier et al. as U.S. Pat. No. 6,839,921. Another patent was issued to Alane on Mar. 7, 2006 as U.S. Pat. No. 7,007,322.

Internationally, Japan Patent No. JP 9140536 was issued to Fumika on Jun. 3, 1997. Another was issued to Kohei on Aug. 15, 1995 as Japan Patent No. JP 7213337 and still yet another was issued on Feb. 4, 2004 to Nobuyuki as Japan Patent No. JP 2003034171.

U.S. Pat. No. 4,097,944

Inventor: Eugene Norman Yulish

Issued: Jul. 4, 1978

A beach mat is formed having an integral pillow and pockets for beach wear or the like. An elongated fabric piece defines the body of the mat, and at one end is folded back upon itself to enclose a pillow in the central portion. In particular, the body of the mat is stitched to the pillow, and the flaps on either side of the pillow are also stitched to the fabric piece and appropriately cut and bound to define pockets for beach wear and the like. The opposite end of the mat carries tie straps, to enclose the appropriately folded mat in a neat package.

U.S. Pat. No. 4,195,378

Inventor: James J. Parker

Issued: Apr. 1, 1980

An oversize, heavy duty beach towel is provided with sealable pockets at one end. The pockets are located so as not to interfere with the use of the towel for drying oneself off after swimming or for reclining. The pockets are designed to enclose various items that may be brought to the beach. One of the pockets is larger than the others, and is located at the middle of one end of the towel to facilitate its use as a pillow when filled with soft, bulky material. Waterproof zippers and linings protect the contents of the pockets from moisture. The towel unit includes a removable handle to be used for retaining the towel and its contents in a convenient package when the towel is rolled or folded.

U.S. Pat. No. 5,622,300

Inventor: Lawrence L. Robinson

Issued: Apr. 22, 1997

A roll pack is formed from a sheet of material having first and second edges. A first storage pocket is positioned along the first edge of the sheet of material. An enclosure is positioned along a second edge of the sheet. A strap is attached to the second edge of the sheet near the enclosure. The strap may be confined by the enclosure. When extended the strap is used to secure the sheet of material when rolled up.

U.S. Pat. No. 5,730,529

Inventor: Kyle D. Fritz

Issued: Mar. 24, 1998

A combination beach mat and carrying device. The mat has a pillow section and several storage sections closed by a closure having a flap to protect the closure from sand. Additionally, the mat has securing straps for binding up the mat for easy transportation, and a carrying strap for carrying the bound up contents. The carrying strap is located along the seam of the pillow and mat sections. The securing straps are extended beyond the bounds of the mat to be located out of the way.

U.S. Pat. No. 5,740,566

Inventor: Murray Stacy

Issued: Apr. 21, 1998

A combination tarpaulin-blanket construction comprises a first, tarpaulin layer of a material such as a cotton canvas, a cotton duck or a cellulose acetate synthetic yarn, and a protective covering of a waterproof and windproof laminated plastic, and a second, blanket layer of a material such as synthetic fleece or wool. The second layer is sewn to a major surface of the first layer to form a tarpaulin-blanket unit of a rectangular shape. Grommets are provided at each corner of the tarpaulin-blanket unit for enabling the unit to be secured in place. Securing straps, affixed to one edge of the tarpaulin-blanket unit, encircle the unit, when the unit is in a rolled-up state, so as to retain the unit in that state. A carrying handle, secured to the one edge between the straps, enables carrying of the unit in the rolled-up state.

U.S. Pat. No. 6,061,849

Inventor: Christopher Seals

Issued: May 16, 2000

A beach towel with built-in pockets and carrying handle including a towel. A pair of small pockets are secured to the towel. A large pocket is secured to the towel. A pair of side straps extend outwardly from first and second long edges of the towel inwardly with respect to a first short edge. A plurality of end straps extend outwardly from the first short edge in a spaced relationship. A pair of carrying handles are secured to the towel along the first short edge thereof.

U.S. Pat. No. 6,223,367

Inventor: Katherina Grace French et al.

Issued: May 1, 2001

The present invention is a stadium blanket having an attached storage bag. The blanket is of sufficient size to allow the blanket to protect a user from the elements or to be used as a sleeping bag. The blanket has a water repellent liner on one side and a fleece for warmth on the other. The storage bag may also be used as a pillow and as an anchor when placed around a users feet. The storage bag may also be lined to enclose and warm a users feet. When not in use, the blanket is folded and enclosed within the storage bag for ease of storage or carrying.

U.S. Pat. No. 6,839,921

Inventor: Robert Cloutier et al.

Issued: Jan. 11, 2005

A foldable towel with a hole in each corner thereof for receipt of anchoring pins and with strapping loops sewn thereto for receipt of strapping wrapable about the towel and conjoined by affixation means located at the respective ends of each piece of strapping to facilitate portability and further characterized by the presence of pockets sewn thereto to on the one hand house a pillow and on the other hand house the pins when the towel is not in use.

U.S. Pat. No. 7,007,322

Inventor: Dawnn Alane

Issued: Mar. 7, 2006

A yoga mat that may be rolled up tightly and then held closed by straps, which wrap around and encircle the rolled up mat. The straps are affixed to the mat by the ends thereof being sewn to the edge of mat under an attachment strip, which fits along one entire edge of the mat. A shoulder strap is also attached under the attachment strip between the two straps, so that the mat can be carried over the shoulder with both hands and arms free.

Japan Patent Number JP 9140536

Inventor: Yamada Fumiko

Published: Jun. 3, 1997

PROBLEM TO BE SOLVED: To provide a portable blanket capable of being turned into a knapsack shape when a zipper is closed.

SOLUTION: Knapsack shoulder straps 2 and 2 led through buckles are connected to the upper part of the outer surface of a blanket 1, and a zipper 3 is attached to an area ranging from the center part to the left side. Also, adult's shoulder straps 9 and 9 are connected to the sides of the blanket 1 and a pocket 4 is formed on the left side part. Furthermore, hook-and-loop fasteners (Magic tape (R)) 7 and 7 are fitted to the center of the pocket 4 and snap hooks are attached to the right and left sides on the center of the blanket 1. Also, a slit 6 is formed on the center and a stuffed toy 8 is provided on the center of a knapsack cover 11. Then the hook-and-loop fasteners 7 and 7 are fitted to the upper part of the cover 11 on the external side of the blanket 1, and snap hooks 5 and 5 are provided on the right and left sides of the center of the cover 11. Also, a slit 6 is formed along the center of the cover 11.

Japan Patent Number JP 7213337

Inventor: Yamada Kohei et al.

Published: Aug. 15, 1995

PURPOSE: To carry a mat in a rolled up state by mounting a band on one side edge of a mat back plane. CONSTITUTION: A surface layer 13 with high decorativeness such as a felt layer or tufting layer is provided at the upper part of a base material 12 with high cushioning performance, for example, a vinyl chloride sheet. The band 16 is mounted on the one side edge of the back plane of the mat 11. The band 16 is to fix the rolled up shape of the mat 11 by tightening by winding across the outside of the mat 11 when the mat is rolled up advancing the side where the band 16 is mounted so as to set the surface of the mat 11 at the inside. The band 16 can be prevented from coming off by inserting the tip of the band 16 between the band 16 and the mat 11 after tightening the band by winding across the outside of a rolled up mat 11, and the mat can be easily carried in the rolled up state.

Japan Patent Number JP 2003034171

Inventor: Nagata Nobuyuki

Published: Feb. 4, 2003

PROBLEM TO BE SOLVED: To provide a mat device with high versatility capable of making a mat compact, easily keeping the cleanliness of the mat, and facilitating the attachment and detachment of the mat.

SOLUTION: This mat device comprises the mat extended in a using state and rolled or folded in a non-using state, and a holding device to be wound on the mat laid in the non-using state to hold the mat in a prescribed position of a vehicle. The width of the mat is matched to the width of one rear seat. The holding device is attachably and detachably mounted on the strut of the headrest of the rear seat. The holding device comprises a belt to be wound on the mat the holding device comprises a mat fixture for attachably and detachably holding the mat, and the mat fixture is positionally adjustable in relation to the belt.

While these mats and blankets may be suitable for the purposes for which they were designed, they would not be as suitable for the purposes of the present invention, as hereinafter described.

SUMMARY OF THE PRESENT INVENTION

A primary object of the present invention is to provide a two ply ground cover.

Another object of the present invention is to provide a two ply ground cover comprising a bottom canvas layer and a top acrylic rug layer.

Yet another object of the present invention to provide a two ply ground cover having a strap retainer fastened to the bottom side with straps extending therefrom.

Still yet another object of the present invention is to provide a two ply ground cover having a handle fixedly attached to the bottom side of the ground cover.

Another object of the present invention is to provide a two ply ground cover that includes a reinforcement patch fixedly attached to the bottom side of the ground cover.

Yet another object of the present invention is to provide a two ply ground cover that is easy to transport and or store.

Still yet another object of the present invention is to provide a two ply ground cover that is easy and cost effective to manufacture.

Additional objects of the present invention will appear as the description proceeds.

The present invention overcomes the shortcomings of the prior art by providing a two ply ground cover comprising a top acrylic rug layer and a bottom canvas layer having a strap retainer fastened to the bottom side with straps extending therefrom and a handle fixed therebetween.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
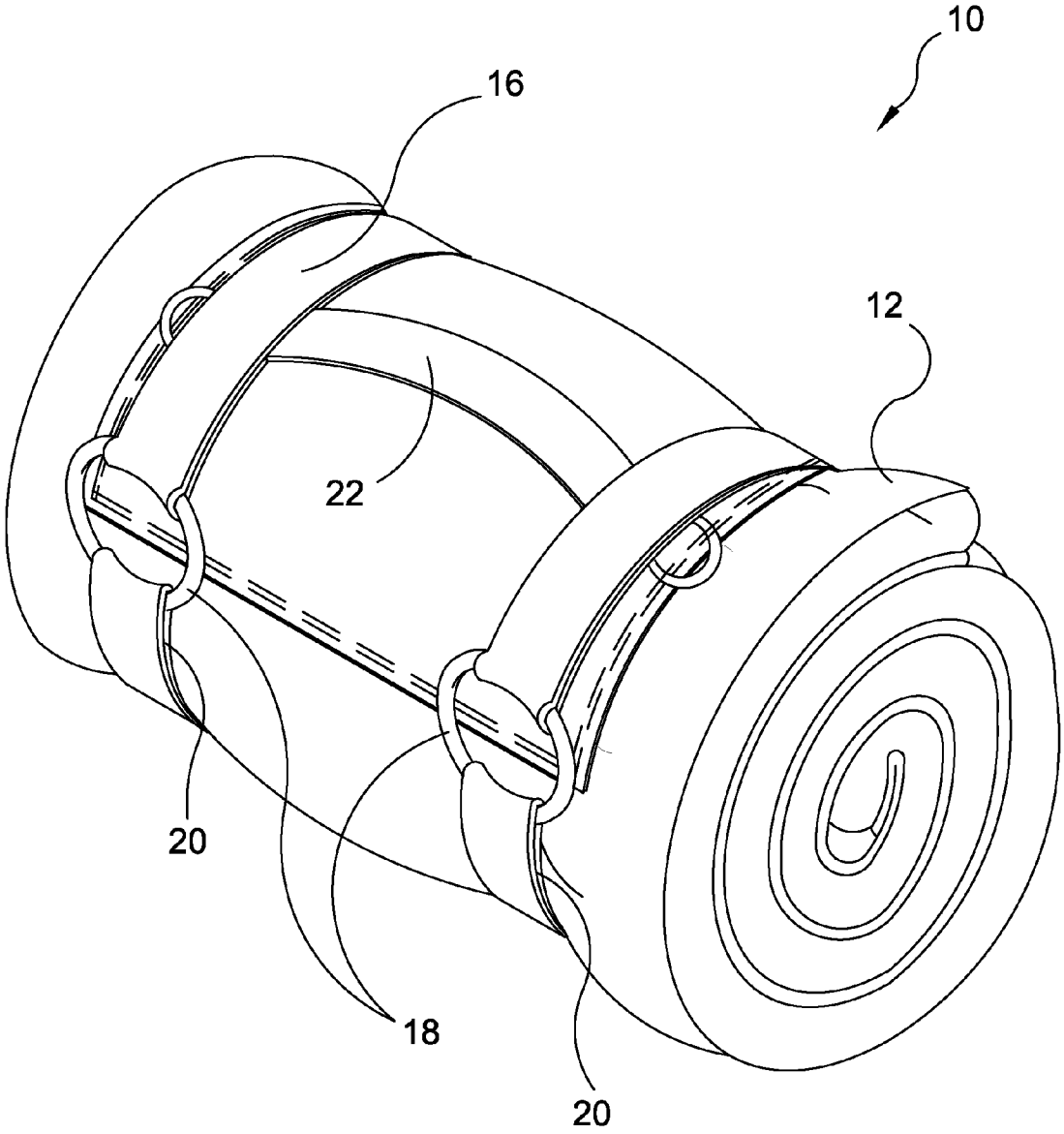
FIG. 1 is an illustrative view of the present invention.

Turning now descriptively to the drawings, in which similar reference characters denote similar elements throughout the several views, the figures illustrate the Utility Rolled Ground Cover Blanket with Integral Strap Securing Assembly of the present invention. With regard to the reference numerals used, the following numbering is used throughout the various drawing figures.

10 Utility Rolled Blanket with Integral Strap Securing Assembly of the present invention
12 ground cover blanket
14 strap assembly
16 fastener strap
18 securing ring
20 hook and loop fastener element
22 handle
24 reinforcement patch
26 stitching
28 proximal end of 16
29 medial portion of 16
30 distal end of 16
31 top side of 16
32 end of 22
34 secondary ring
36 shoulder strap
38 clasp of 36
40 bottom sheet of 12
42 outer side of 40
44 rubberized material
46 grommet
48 corner of 12
50 quarter section of 12
52 inner side of 40
54 inner compartment of 12
56 zipper
58 first edge of 12
60 second edge of 12
62 center line of 12
64 top sheet of 12
66 battery pack
68 heating element

DETAILED DESCRIPTION OF THE PREFERRED EMBODIMENT

The following discussion describes in detail one embodiment of the invention. This discussion should not be construed, however, as limiting the invention to one particular embodiment, practitioners skilled in the art will recognize numerous other embodiments as well. For definition of the complete scope of the invention, the reader is directed to appended claims.

FIG. 1 is an illustrative view of the present invention 10. Shown is an illustrative view of the present invention 10 depicting the device being a foldable and rollable 2-ply blanket 12 having a pair of parallel fastener straps 16 with cooperating securing rings 18 whereby said blanket 12 can be folded and rolled into a compact configuration and secured as such by the straps 16. To secure the device the straps 16 may be outfitted with mating hook and loop fastener elements 20 once the distal ends of the straps 16 are looped through the rings 18 and folded upon themselves to engage the hook and loop fasteners 20. A transverse handle 22 is included for ease of carrying when in the wrapped and secured position.

Figure 2:
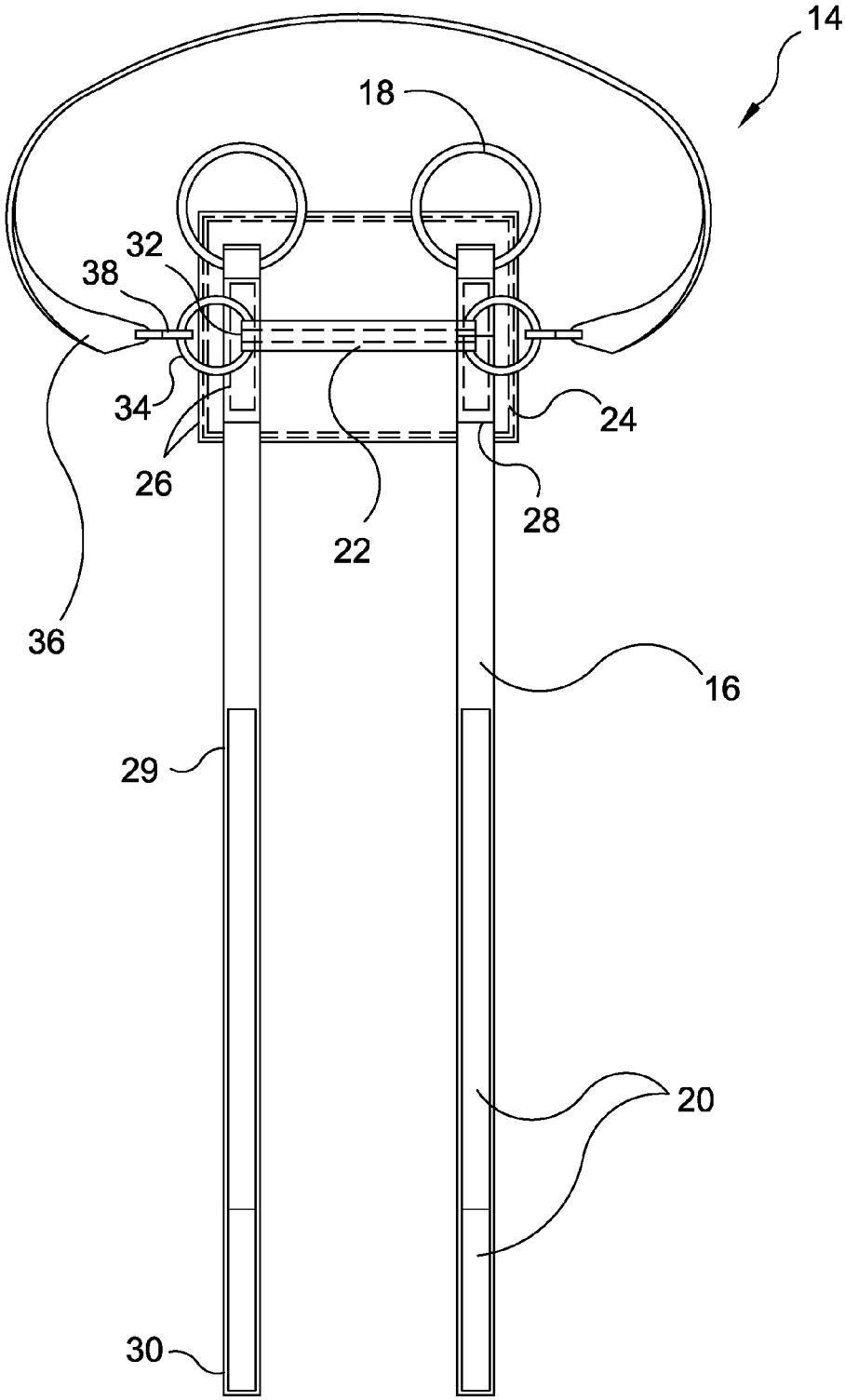
FIG. 2 is an illustrative view of the straps, handle and rings of the present invention.

FIG. 2 is an illustrative view of the strap assembly 14. Shown are the straps 16, handle 22 and rings 18 secured to a reinforcement patch 24 removed from a blanket to depict how the securing system for the blanket can be utilized on any size or type of blanket as a sewn on unit. Shown are the proximal ends 28 of the straps 16 looped through the rings 18 and folded upon themselves and stitched 26 together onto the reinforcement patch 24. The handle 22 traverses the central portion of the reinforcement patch 24 in perpendicular relation to the straps 16 with the ends 32 looped through secondary rings 34 for receiving the clasps 38 of a shoulder strap 36. Hook and loop fastener elements 20 extend from the medial portion 29 to the distal end 30 of the top side 31 of each strap 16.

Figure 3:
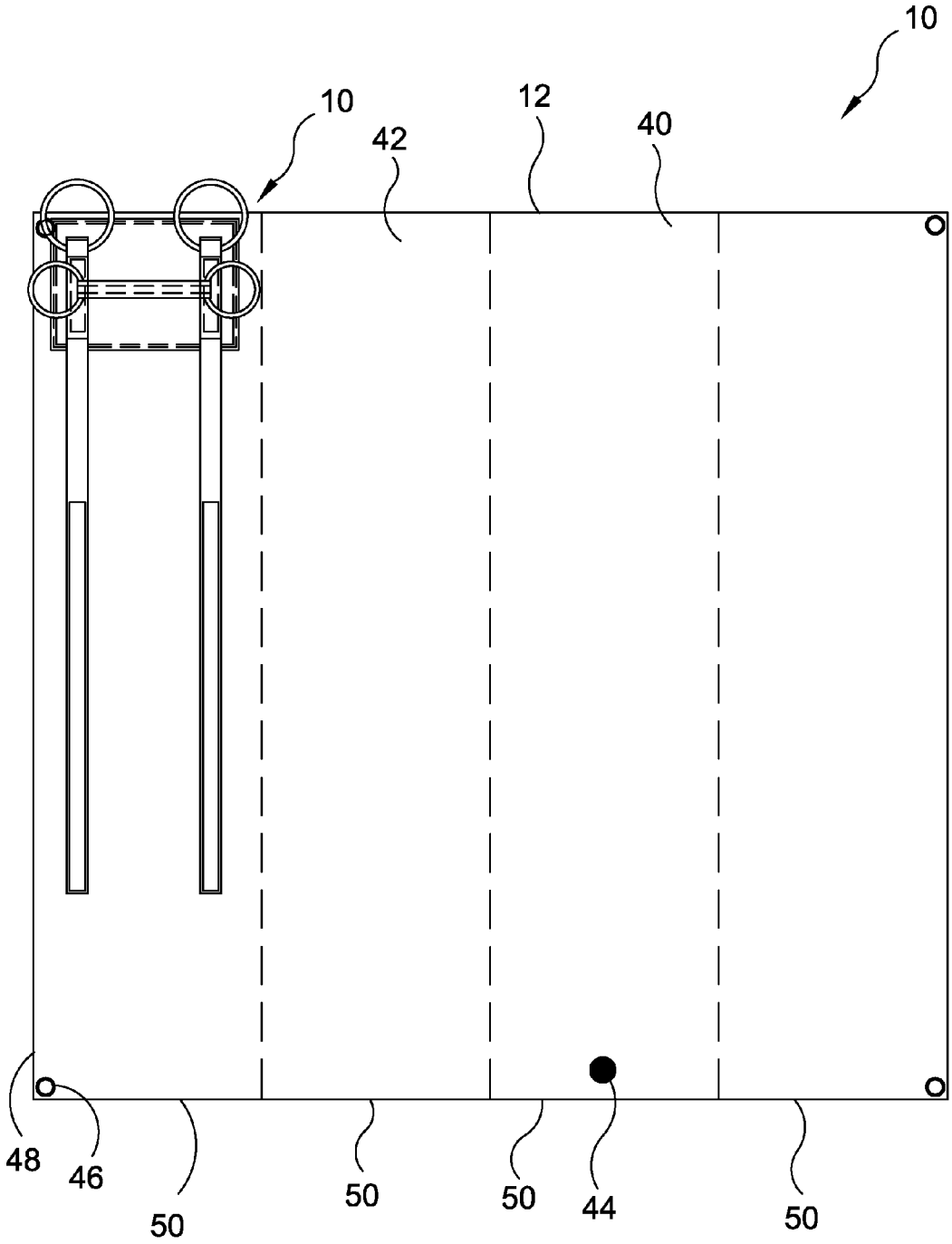
FIG. 3 is an illustrative view of the present invention sewn to the back of a blanket.

FIG. 3 is an illustrative view of the present invention 10 with the strap assembly 14 sewn to the bottom side 42 of the bottom sheet 40 of the blanket 12. The bottom side 42 may include water proofing, a rubberized material 44 or extra rugged construction for contact with a ground surface. The blanket 12 is folded in quarter sections 50 with the strap assembly 14 approximately the width of one section 50. Grommets 46 are disposed in the corners 48 of the blanket 12 to enable the user to stake it down to prevent the casual displacement thereof.

Figure 4:
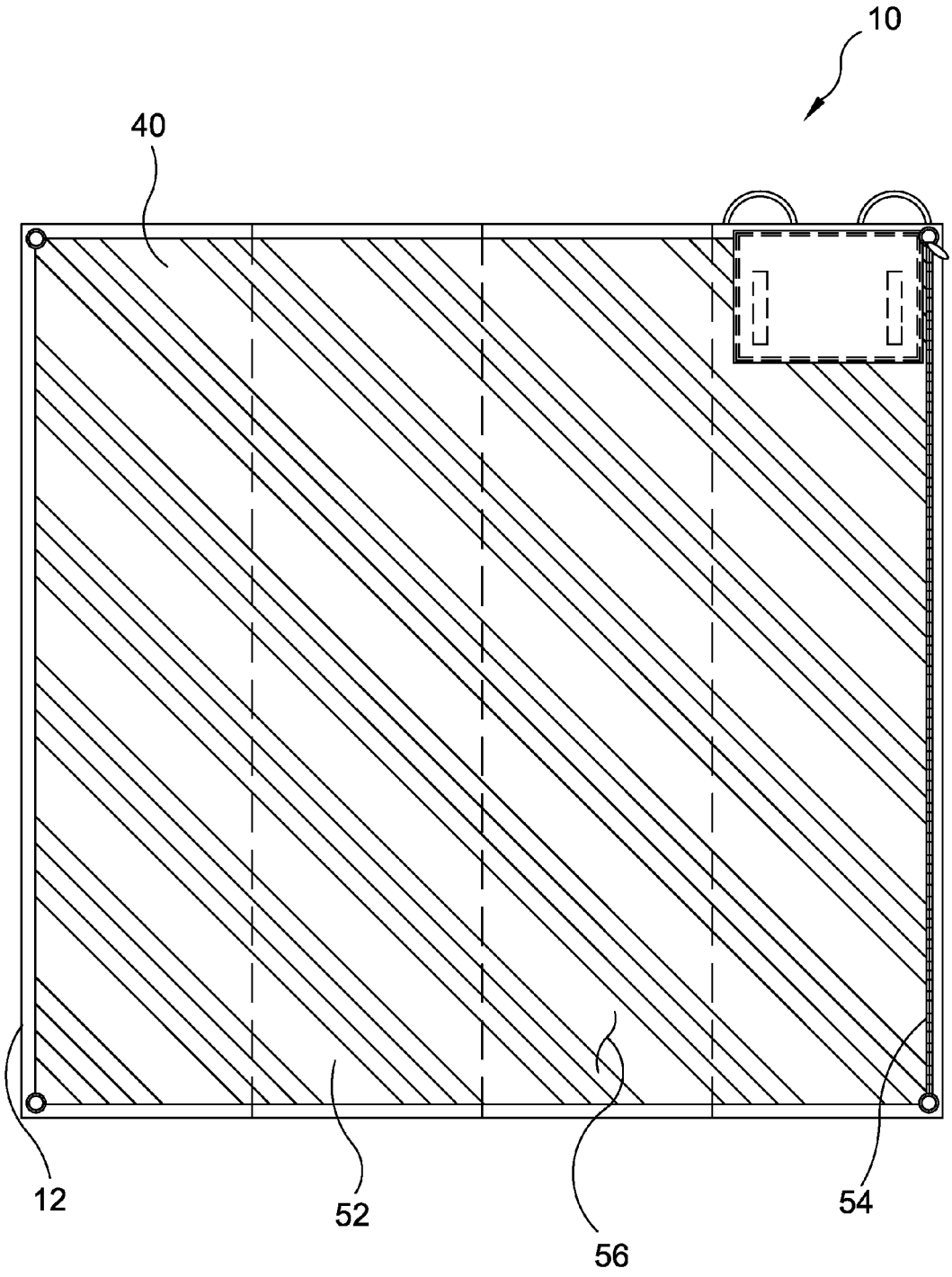
FIG. 4 is an illustrative view of the inside of the blanket of the present invention.

FIG. 4 is an illustrative view of the inner side 52 of the bottom sheet 40 of the blanket 12 of the present invention 10 laid out and unfolded. A zipper 54 is provided to provide access to the inner compartment 56 between the bottom sheet 40 and the top sheet to allow for the insertion of additional padding therein including foam padding or an air mattress. The zipper 54 may also be disposed along all four edges of the blanket 12 to remove the sheets from each other. Additionally shown in dotted line are regions whereby the blanket 12 is folded to reduce width for rolling securing and storage of the blanket portion.

Figure 5:
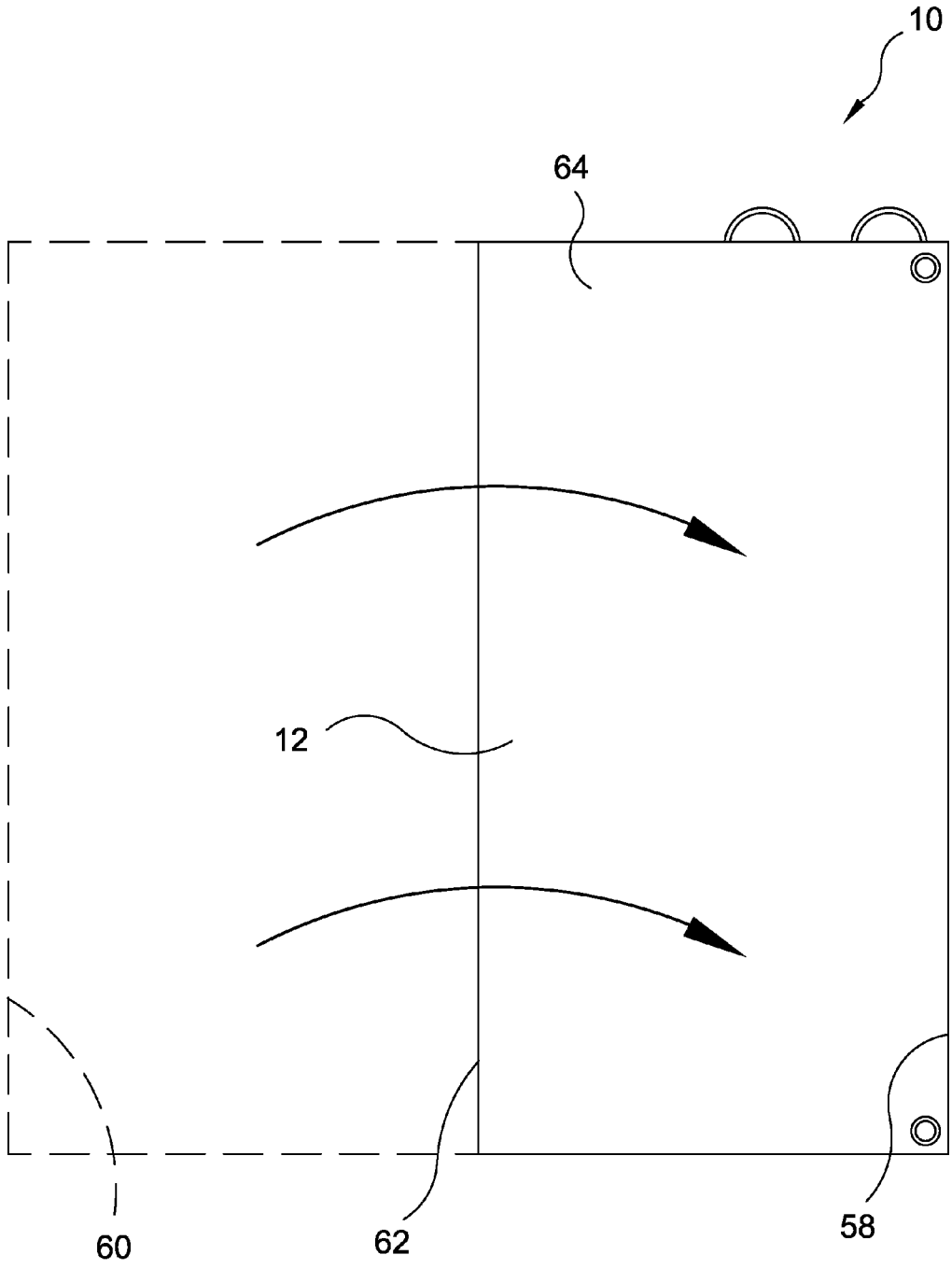
FIG. 5 is an illustrative view of the blanket folding process of the present invention.

FIG. 5 is an illustrative view of the blanket 12 folding process of the present invention 10. Shown is the top sheet 64 of the blanket 12 with a second edge 60 that is first folded over to the first edge 58 at the center line 62. Whereby it will be followed by the second side in the same manner.

Figure 6:
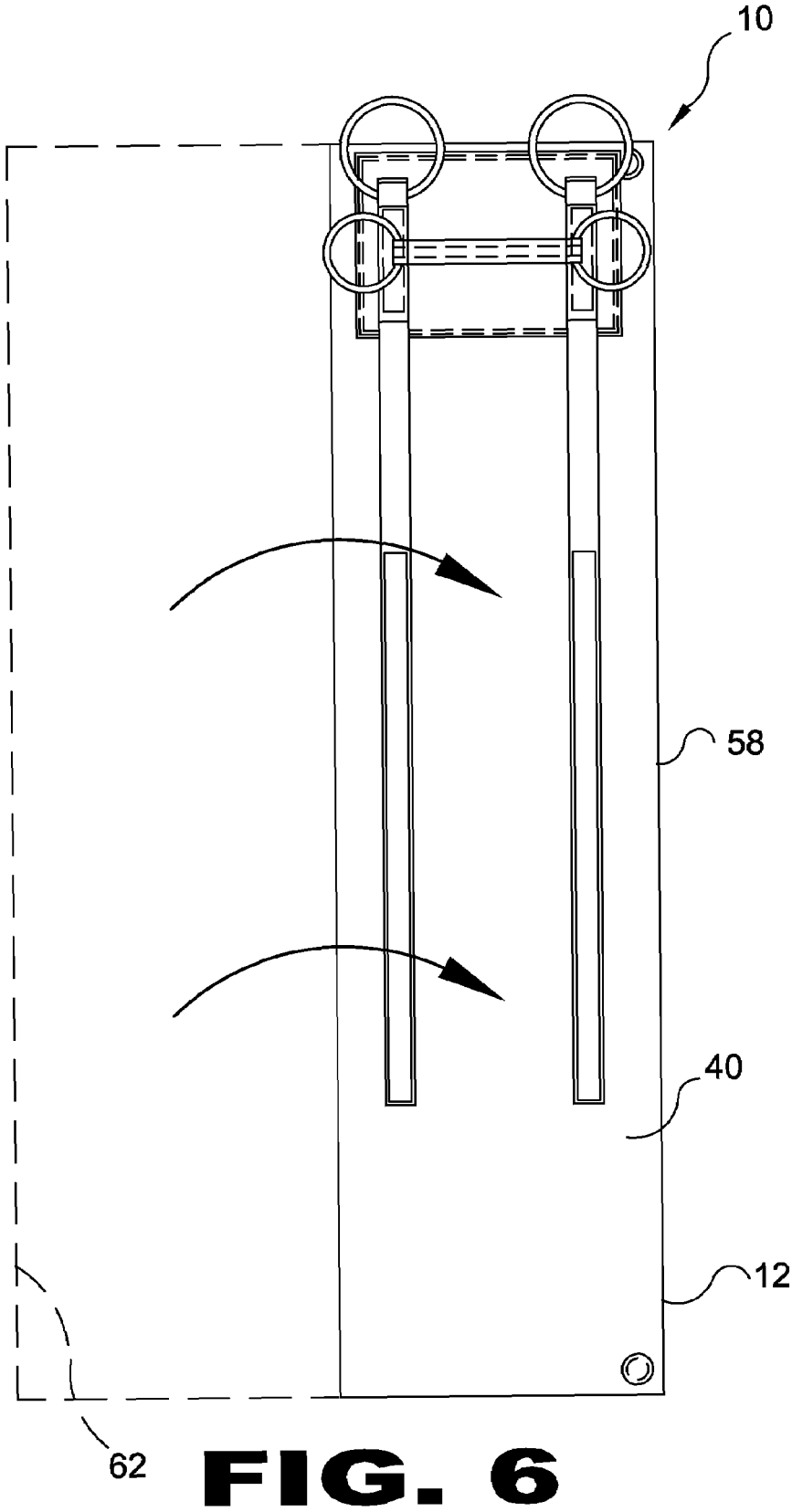
FIG. 6 is an illustrative view of the blanket folding process of the present invention.

FIG. 6 is an illustrative view of the blanket folding process of the present invention 10. Shown is the bottom sheet 40 a blanket 12 with the center line 62 folded over to align with the first edge 58 to situate the blanket into an elongated folded extending strip.

Figure 7:
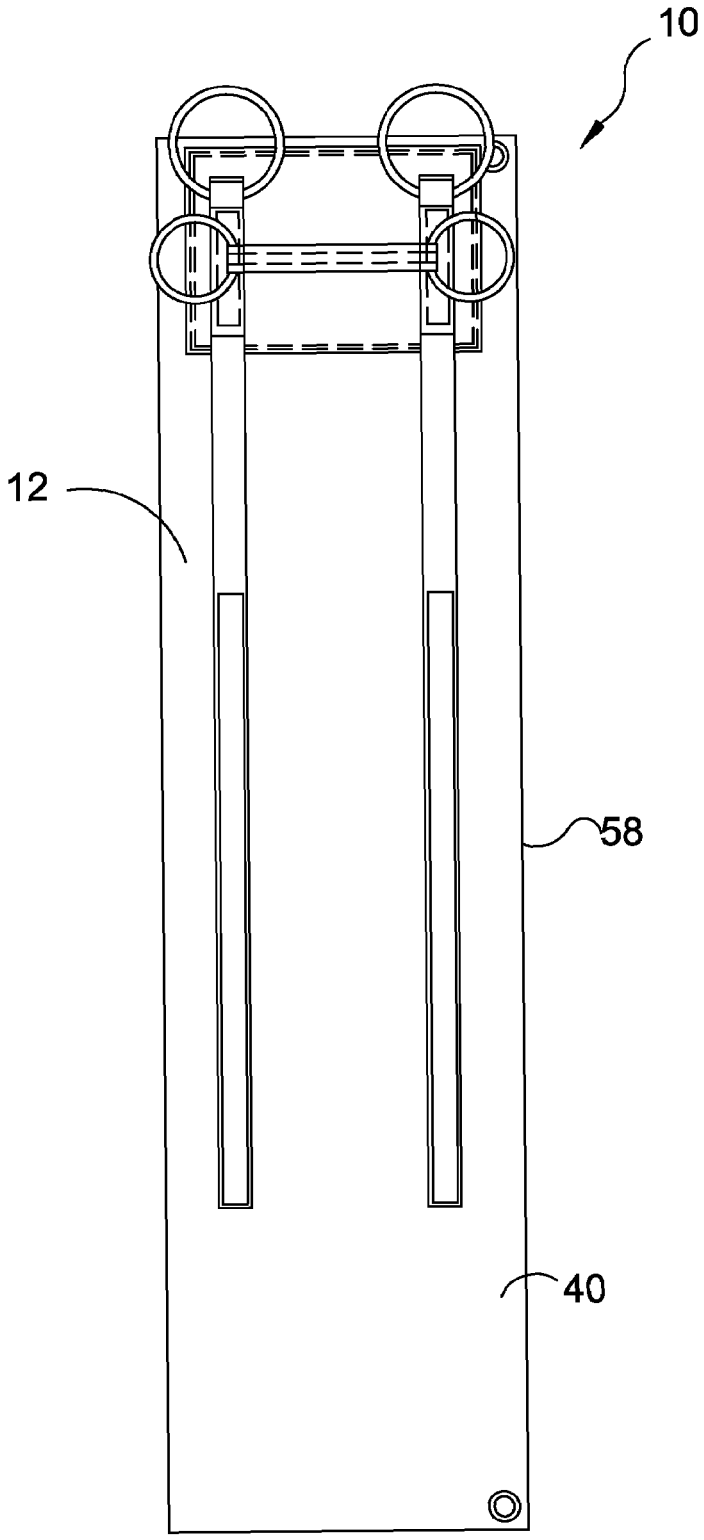
FIG. 7 is an illustrative view of the blanket folding process of the present invention.

FIG. 7 is an illustrative view of the blanket folding process of the present invention 10. Shown is the bottom sheet 40 a blanket 12 with the center line folded over to align with the first edge 58 to situate the blanket into an elongated folded extending strip.

Figure 8:
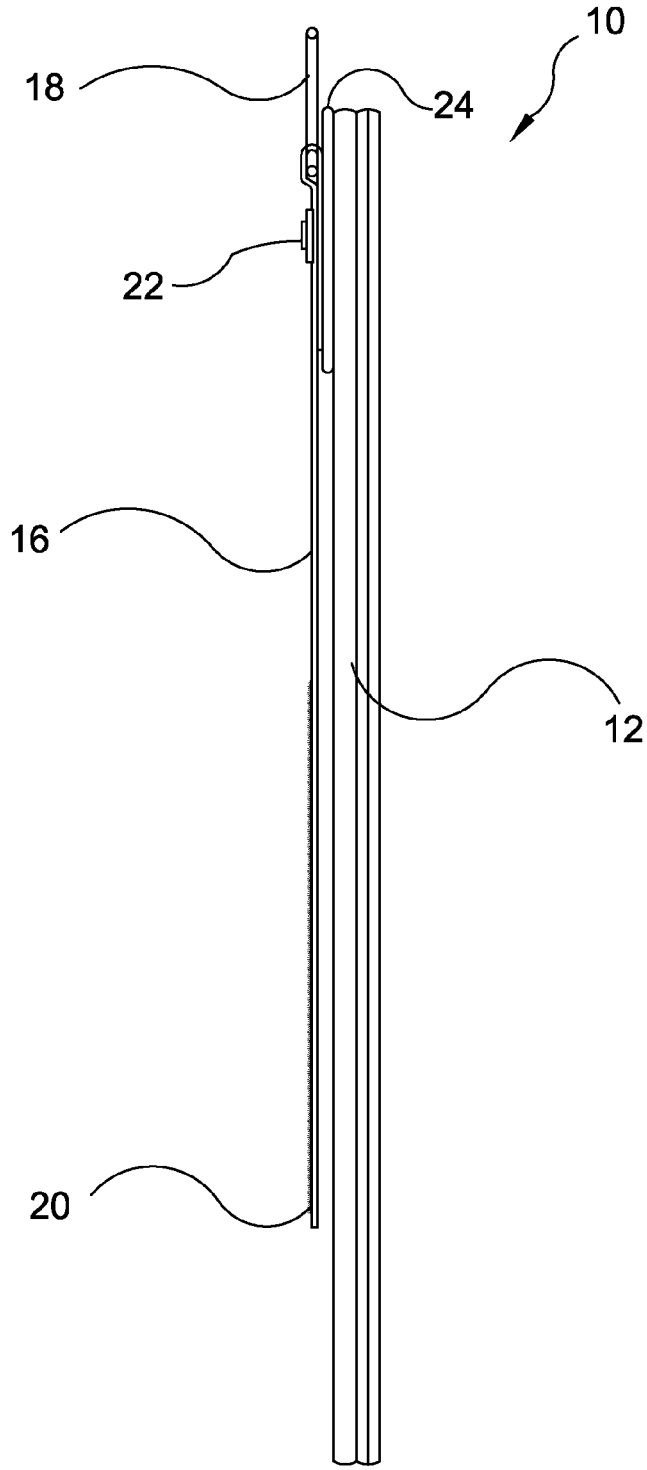
FIG. 8 is a side view of the present invention.

FIG. 8 is a side view of the present invention 10. Shown is a side view of the reinforcement patch 24 attached to a blanket 12 in a state ready to be rolled and secured for transportation or storage. Also shown is the ring 18, handle 22, strap 16, and hook and loop fastener 20.

Figure 9:
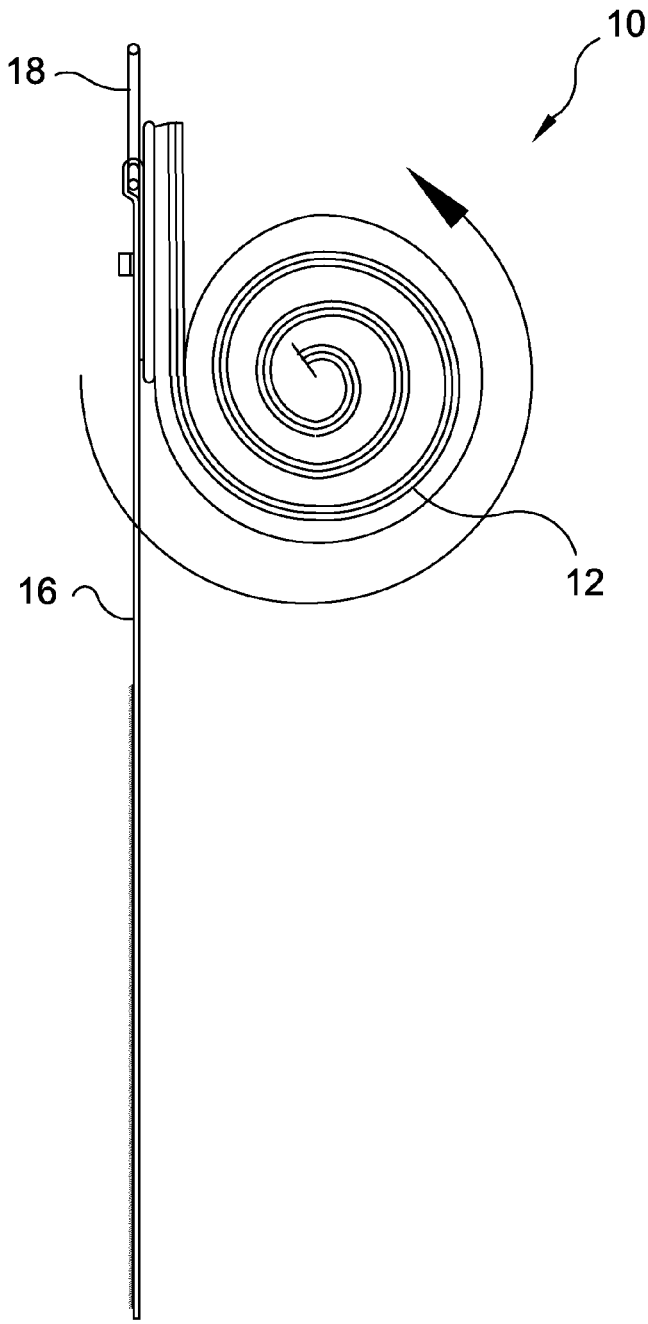
FIG. 9 is a side view of the present invention with the blanket rolled up.

FIG. 9 is a side view of the present invention 10 with the blanket 12 rolled up. Shown is a side view of the blanket 12 rolled up and in a configuration whereby the straps 16 and rings 18 can be utilized to secure the blanket 12 into a rolled configuration.

Figure 10:
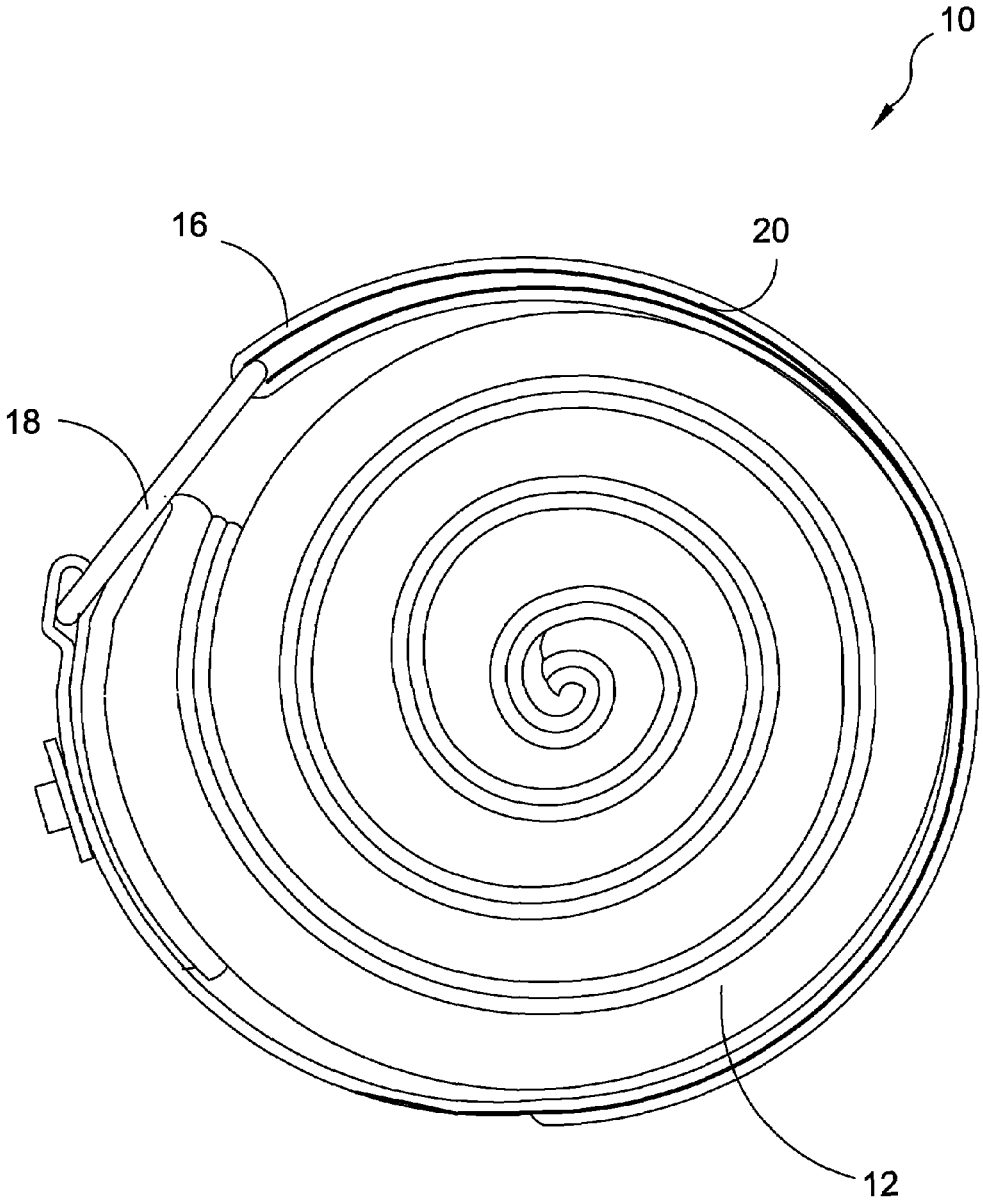
FIG. 10 is a side view of the present invention rolled up.

FIG. 10 is a side view of the blanket 12 of the present invention 10 rolled up and bound by utilizing the attached straps 16 and rings 18. Additionally the straps 16 of the present invention 10 have hook and loop fasteners 20 on the surface of the strap 16 that are placed in a location whereby said fasteners may engage after being pulled through a ring 18.

Figure 11:
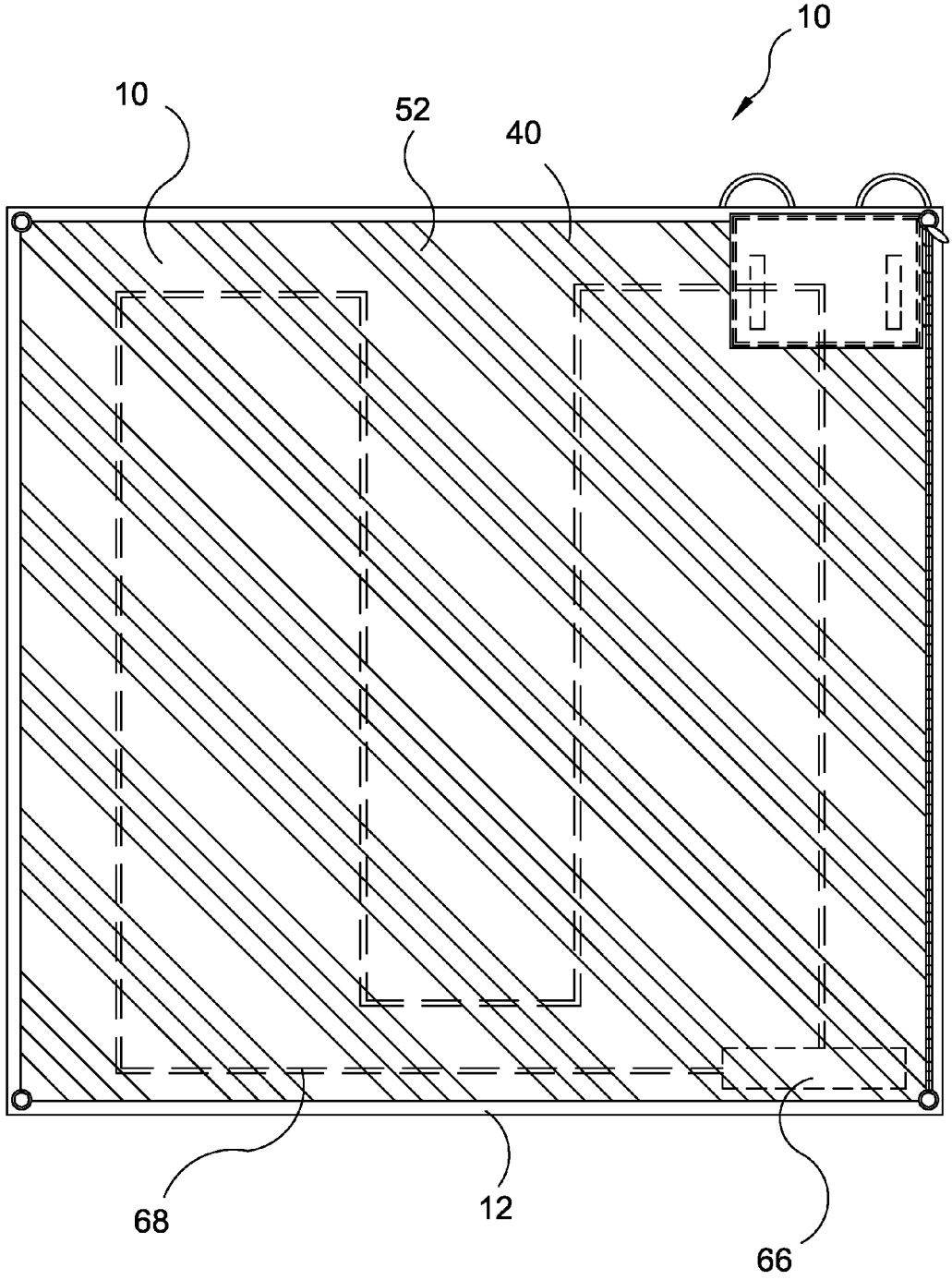
FIG. 11 is an illustrative view of the inside of the blanket of the present invention having an additional element.

FIG. 11 an illustrative view of the inner side 52 of the bottom sheet 40 of the blanket 12 of the present invention 10 having an additional element of a battery pack 66 operated heating element 68 integrated into the form of the present invention.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A 2-ply ground cover blanket with securing means comprising:

a) a blanket comprising;

i) a flexible bottom sheet constructed of a durable material; and ii) a flexible top sheet constructed of a soft comfortable material and secured to said bottom sheet at the respective edges thereof; and b) a strap assembly for securing blanket in a specifically folded and rolled position, said strap assembly comprising a pair of spaced apart, parallel fastener straps, each having a securing ring disposed at one end, and mating hook and loop fastener elements disposed on the same side of the opposing end of the strap, said fastener straps being stitched proximal to the edges of a reinforcement patch which in turn is stitched to a corner of said blanket, said strap assembly further comprising a transverse handle strap having the ends thereof stitched to said reinforcement strap, whereby the blanket can be folded, rolled and secured into a compact configuration for ease of storage and transportation.

2. The ground cover blanket with securing means recited in claim 1, wherein the width of said reinforcement patch is substantially equivalent to ¼ of the width of said blanket.

3. The ground cover blanket with securing means recited in claim 1, wherein said handle strap further includes a secondary ring attached to each end thereof.

4. The ground cover blanket with securing means recited in claim 3, including a removable shoulder strap having a clasp member that attaches to said secondary rings for use to carry and transport over the shoulder of the user.

5. The ground cover blanket with securing means recited in claim 1, wherein said blanket has a first edge proximal to said strap assembly and parallel with said fastener straps, a second opposing edge and a center line disposed equidistantly therebetween.

6. The ground cover blanket with securing means recited in claim 5, wherein said blanket is folded from the flat laid out position with the bottom side with strap assembly facing downward and folding said second edge of said blanket over to said first edge at said center line resulting with said top sheet folded upon itself in face to face relation and subsequently folding said center line over to said first and second edges so said blanket is folded to ¼ of it's entire width.

7. The ground cover blanket with securing means recited in claim 6, wherein the bottom edge of said blanket furthest from said strap assembly is rolled up until the blanket roll resides thereupon.

8. The ground cover blanket with securing means recited in claim 7, wherein said blanket is secured in the rolled position by wrapping said fastener straps around said blanket, inserting the distal ends thereof through their respective securing rings and pulling taut before folding them upon themselves to engage the hook and loop fastener elements.

9. The ground cover blanket with securing means recited in claim 1, wherein said blanket has grommets disposed in each corner to enable the user to stake said blanket into place when in use to prevent the casual displacement thereof.

10. The ground cover blanket with securing means recited in claim 1, wherein said blanket further includes and interior compartment disposed between said top sheet and said bottom sheet.

11. The ground cover blanket with securing means recited in claim 10, wherein said interior compartment is accessible through a zipper fastening element disposed on at least one edge thereof connecting said top sheet to said bottom sheet.

12. The ground cover blanket with securing means recited in claim 11, wherein a padded element is inserted into said interior compartment at the user's discretion to provide additional cushioning thereto during use.

13. The ground cover blanket with securing means recited in claim 11, wherein said zipper fully encompasses the peripheral edges of said blanket thereby enabling the user to selectively remove said top sheet from said bottom sheet.

14. The ground cover blanket with securing means recited in claim 1, further comprising a heating element disposed within said bottom sheet that is energized by a battery pack.

* * * * *